US008106850B1

(12) United States Patent
Gregoire et al.

(10) Patent No.: US 8,106,850 B1
(45) Date of Patent: Jan. 31, 2012

(54) ADAPTIVE SPECTRAL SURFACE

(75) Inventors: Daniel J. Gregoire, Thousand Oaks, CA (US); Gregory Olson, Whitefish, MT (US)

(73) Assignee: HRL Laboratories, LLC, Malibu, CA (US)

( * ) Notice: Subject to any disclaimer, the term of this patent is extended or adjusted under 35 U.S.C. 154(b) by 1178 days.

(21) Appl. No.: 11/644,245

(22) Filed: Dec. 21, 2006

(51) Int. Cl.
*H01Q 15/23* (2006.01)

(52) U.S. Cl. ..... 343/909

(58) Field of Classification Search ..... 343/753, 343/754, 909
See application file for complete search history.

(56) References Cited

U.S. PATENT DOCUMENTS

| | | | | |
|---|---|---|---|---|
| 1,301,473 | A | 4/1919 | Marconi et al. | |
| 3,789,404 | A | 1/1974 | Munk | |
| 4,125,841 | A | 11/1978 | Munk | |
| 5,208,603 | A | 5/1993 | Yee | |
| 6,025,725 | A * | 2/2000 | Gershenfeld et al. | 324/652 |
| 6,054,947 | A * | 4/2000 | Kosowsky | 342/191 |
| 6,927,745 | B2 * | 8/2005 | Brown et al. | 343/909 |
| 7,212,147 | B2 * | 5/2007 | Messano | 342/4 |

OTHER PUBLICATIONS

Schoenlinner and Kempel, Switchable Low-Loss RF MEMS Ka-Band Frequency-Selective Surface, IEEE Transactions on Microwave Theory and Techniques, vol. 52, No. 11, Nov. 2004.

Munk, Ben A., Frequency Selective Surfaces, Theory and Design, ISBN: 0417370479, 2003, Chapter 1 pp. 1-25; Chapter 2 pp. 26-59, John Wiley & Sons, Inc.

Joannopoulos, Meade and Winn, Photonic Crystals, ISBN: 0691037442, 1995, Chapter 5 pp. 54-77, Princeton University Press.

* cited by examiner

*Primary Examiner* — Michael C Wimer
(74) *Attorney, Agent, or Firm* — Christopher R. Balzan

(57) ABSTRACT

In various embodiments, an adaptive spectral surface is provided including an upper layer having a frequency selective surface, a lower layer being at least partially reflective, and an active dielectric material layer therebetween. The active dielectric material may include a dielectric material with an adjustable permittivity, permeability, or thickness. The active dielectric material may be a dielectric material adapted to change its dielectric constant in response to at an applied electric field, an applied magnetic field, or/and thermal stimulus. Some embodiments allow shifting of the resonance of the spectral absorptive/reflective emissions of the adaptive spectral surface. Some embodiments allow modification of the electromagnetic signature of an adaptive spectral surface apparatus.

35 Claims, 5 Drawing Sheets

ADAPTIVE SPECTRAL SURFACE

BACKGROUND

A frequency selective surface or FSS has many useful applications. For example, U.S. Pat. No. 5,208,603, by James S. Yee, entitled: FREQUENCY SELECTIVE SURFACE (FSS), issued May 4, 1993, herein incorporated by reference, shows one possible type and application. Considerable work is being done in making an FSS with switchable or adaptive properties, most notably to switch it from being a band pass to a band-stop device. Typically this is accomplished with the fabrication of multiple MEMS switches into the FSS layer.

Such techniques, while being technologically very impressive, require enormously complex fabrication and testing. The MEMS FSS techniques are also very difficult to scale to frequencies much higher than 50-100 GHz because of the complexity of the MEMS switches.

What is needed is an adaptive FSS that is more easily fabricated. Further, what is needed is device that may be easily fabricated to operate at frequencies higher than 50-100 GHz.

SUMMARY

In various embodiments, an adaptive spectral surface apparatus is provided including an upper layer having a frequency selective surface, a lower layer being at least partially reflective, and an active dielectric material layer between the upper layer and the lower layer.

In some embodiments, the active dielectric material includes a dielectric material with an adjustable permittivity and/or permeability of the active dielectric layer or thickness. In some embodiments, the active dielectric material may be a dielectric material adapted to change its dielectric constant in response to an applied electric field, an applied magnetic field, or/and thermal stimulus.

It is possible in some embodiments to shift the resonance of the absorptive/reflective spectrum of the adaptive spectral surface apparatus. Further, it is possible in some embodiments to modify the electromagnetic signature of an adaptive spectral surface apparatus.

BRIEF DESCRIPTION OF THE DRAWINGS

The features and advantages of the present invention will be better understood with regard to the following description, appended claims, and accompanying drawings where:

DESCRIPTION

In various embodiments, an adaptive spectral surface includes a frequency selective surface (which may be a frequency selective layer) on a dielectric layer. The adaptive spectral surface alters the spectral properties of a surface. It reflects an incident electromagnetic wave, and/or alters an emitted radiation, according to a frequency response. The resonant frequency of the frequency response is based on the geometry of the frequency-selective surface, and the electromagnetic properties of the dielectric layer, such as the permittivity and the permeability. The resonant frequency can be a frequency of maximum reflection or absorption of electromagnetic radiation. The permittivity of the dielectric layer may be modified to change the frequency response of the adaptive spectral surface by changing the resonant frequency of the frequency response.

Figure 1:
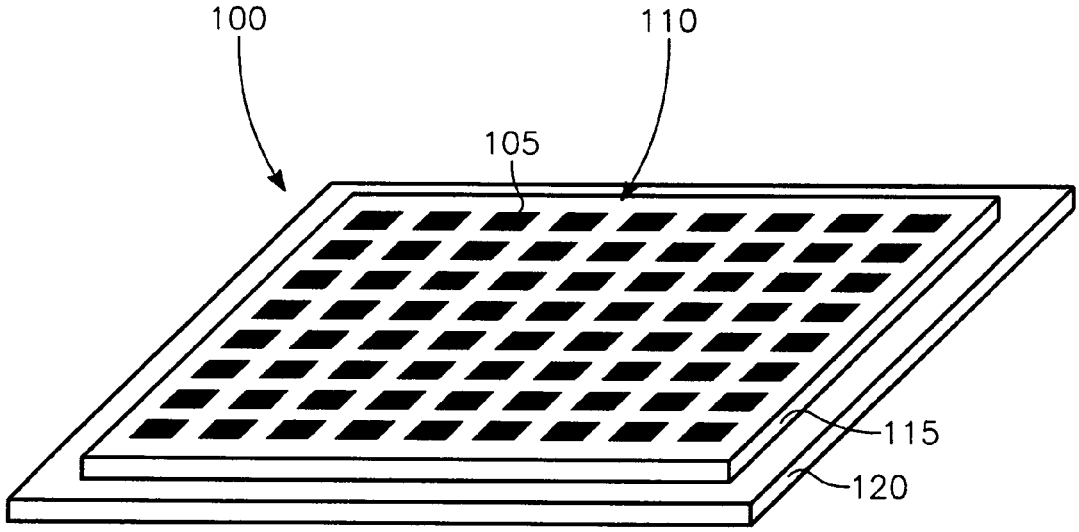
FIG. 1 is a perspective view of an adaptive spectral surface, in accordance with an embodiment of the present invention.

FIG. 1 illustrates an adaptive spectral surface 100, in accordance with an embodiment of the present invention. The adaptive spectral surface 100 includes an upper layer 105, a lower layer 120, and active dielectric layer 115 between the upper and lower layers 105 an 120. The upper layer 105 is a frequency selective surface that includes a spatially-periodic pattern 110. The upper layer 105 may be an electromagnetic crystal, a photonic band gap material, a metasurface, or the like.

The active dielectric layer 115 includes a dielectric material, such as, for example, a ferroelectric or a ferrite. Additionally, the active dielectric layer 115 has properties such as a permittivity, permeability, and a size (e.g., length, width, and thickness), which can be modified in response to a stimulus, such as heat or electromagnetic field. In various embodiments, the active dielectric layer 115 is comprised of a material that is a broadband absorber, which absorbs incident electromagnetic radiation in the spectrum of interest.

The upper layer 105 and the active dielectric layer 115 may be fabricated with conventional printed circuit board techniques, electrochemical etching techniques, or photochemical etching techniques. For example, the active dielectric layer 115 may be a thin dielectric layer, and the spatially-periodic pattern 110 of the upper layer 105 may be created by printing textured metallization onto the active dielectric layer 115. For example, the active dielectric layer 115 may have a thickness of 100-500 nanometers.

The lower layer 120 can include or be, depending on the embodiment, a reflective ground plane, a transmissive medium, a neutral semiconductor substrate, or nonexistent. In some embodiments, the active dielectric layer 115 may be composed of ferroelectric materials such as $BATiO_3$, $SRTiO_3$, $BaSrTi_3$, $LiTaO_3$, $LiNbO_3$, $LaSrMnO_3$ or one of several ferrite compositions. The upper layer 105, the active dielectric layer 115, and the lower layer 120 may be formed by using conventional semiconductor processing techniques. Moreover, the adaptive spectral surface 100 may be a laminated structure of the upper layer 105, the active dielectric layer 115, and the lower layer 120.

Figure 3A:
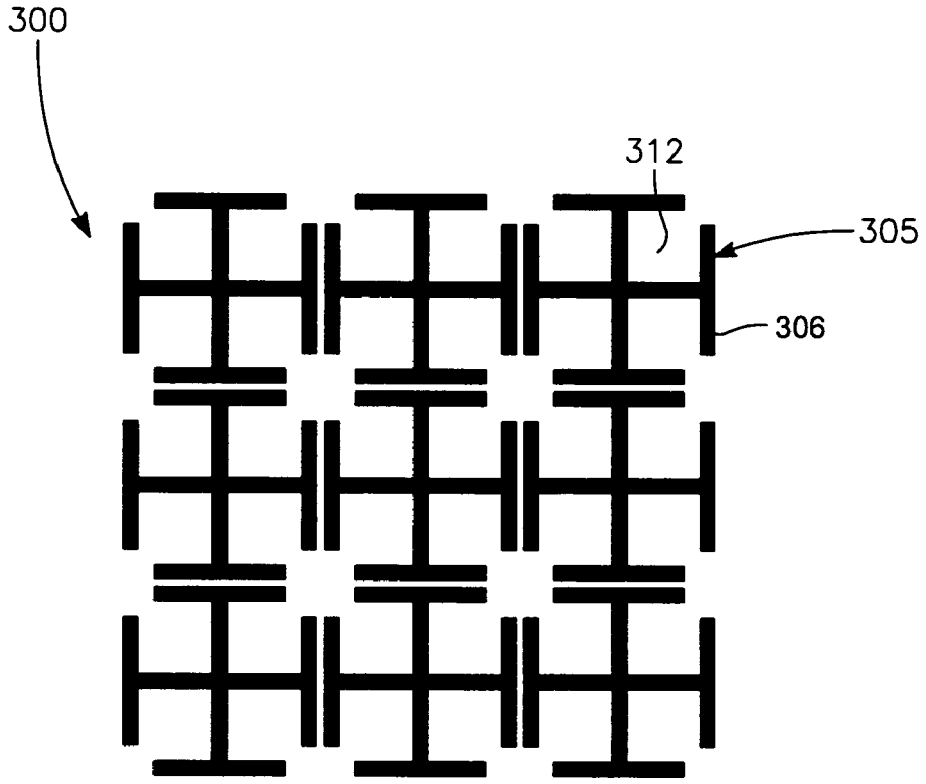
FIG. 3A is a top view of a possible frequency selective surface.
Figure 3B:
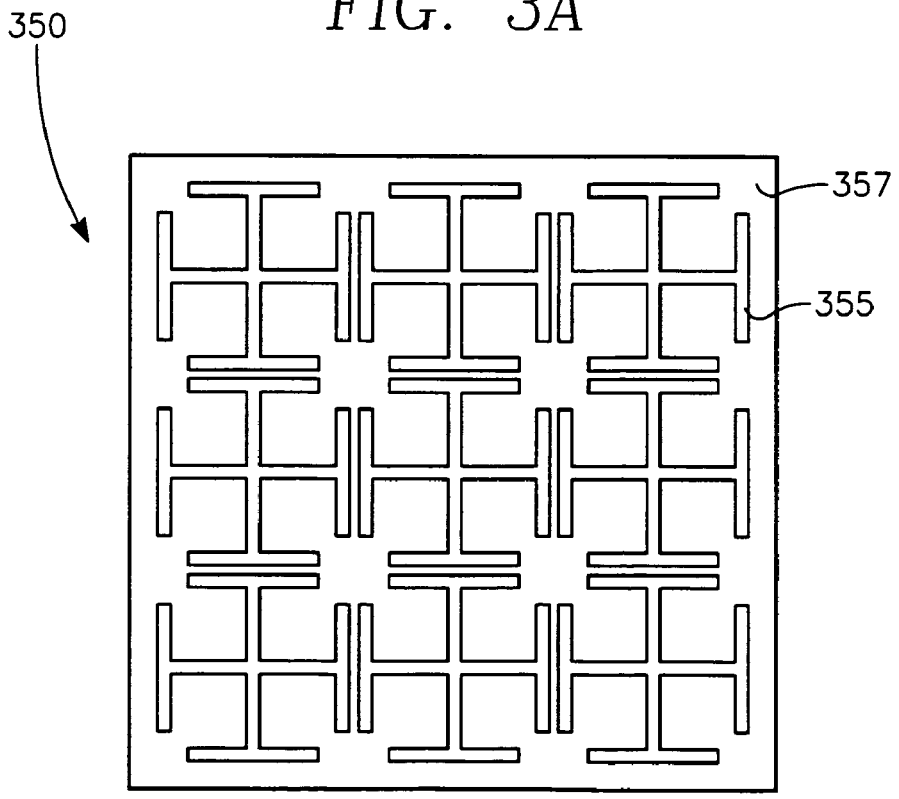
FIG. 3B is a top view of a possible frequency selective surface.

In one embodiment, the spatially-periodic pattern 110 includes an arrangement of conductive traces. The shape of the conductive pattern may take many forms. For example, in FIG. 1, the conductive portion is substantially shaped like a square. In FIGS. 3A and 3B, the conductive shape is substantially shaped like a Jerusalem cross. In other embodiments, the spatially periodic pattern may be composed of crosses, linear slots, rectangular patches, strips, spirals, etc. The effects of various geometric shapes in an FSS are well documented in current literature. The spatially periodic pattern 110 functions to establish a frequency response of the adaptive spectral surface 100 in response to an electromagnetic wave incident on the upper layer 105.

The FSS pattern may also be composed of the inverse of any pattern mentioned above; the inverse is defined as being the case where the metal is replaced with empty space and the empty space is replaced with metal. Two major classifications of patterns exist in the state of the art, known as series-resonant and parallel-resonant. The names are derived from analogous resonant electronic circuits. The inverse of a series-resonant FSS pattern is a parallel-resonant FSS pattern and vice versa.

Figure 3C:
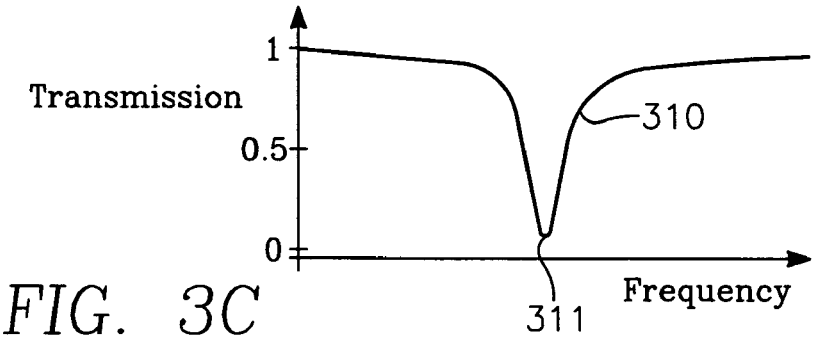
FIG. 3C is a plot representative of a transmission spectrum of an electromagnetic wave incident on a series-resonant FSS.
Figure 3D:
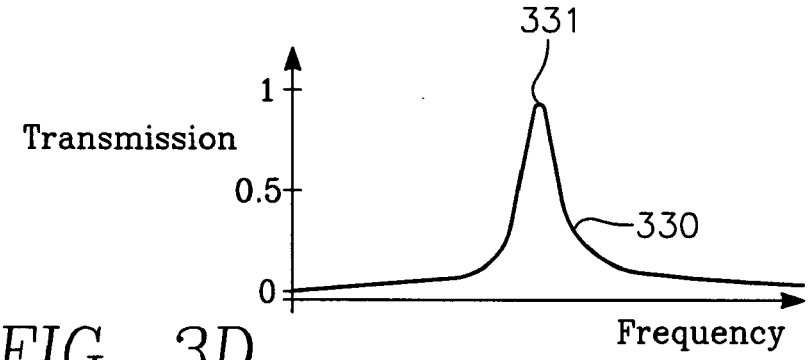
FIG. 3D is a plot representative of a transmission spectrum of an electromagnetic wave incident on a parallel-resonant FSS.
Figure 3E:
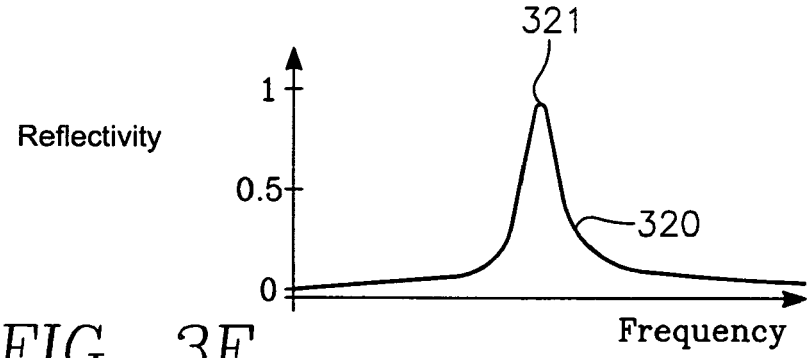
FIG. 3E is a plot illustrating the reflective power corresponding to the plot of FIG. 3C.

Turning to FIGS. 3A and 3B, a series-resonant FSS pattern 300 is typically composed of patches of patterned metal 305 separated, and electrically isolated, from each other by an insulating material 312. FIG. 3A is an example of a series-resonant FSS pattern with the metal patches 306 in the shape of Jerusalem crosses. FIG. 3C is representative of the transmission spectrum 310 of an electromagnetic wave incident on a series-resonant FSS; it features a sharp dip 311 in the transmitted power at the resonant frequency. The resonant frequency is defined by the details of the pattern shape and its spatial period. The reflected power 320, shown in FIG. 3E, is related to the transmitted power 310, shown in FIG. 3C, by $r=1-t$, where r is the reflected power and t is the transmitted power.

Figure 3F:
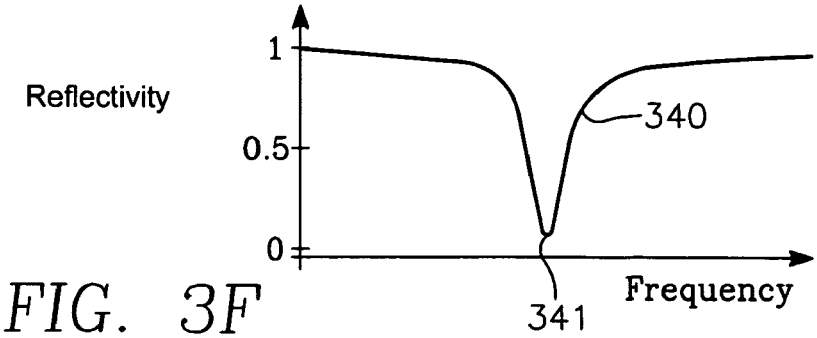
FIG. 3F is a plot illustrating the reflective power corresponding to the plot of FIG. 3D.

FIG. 3B is an example of a parallel-resonant FSS pattern 350 that is the inverse pattern of the series-resonant FSS pattern 300 shown in FIG. 3A. It is composed of an array of Jerusalem-cross shaped holes 355 in a metallic sheet 357. FIG. 3D is representative of the transmission spectrum 330 of an electromagnetic wave incident on a parallel-resonant FSS; it features a sharp peak 331 in the transmitted power at the FSS's resonant frequency. The reflected power 340, shown in FIG. 3F, is related to the transmitted power 330 by $r=1-t$.

Referring to FIG. 1, the active dielectric material 115 is a broadband absorber that absorbs incident electromagnetic radiation. The active dielectric material 115 works in conjunction with the patterned FSS layer 110 to modify the surface's emission spectrum (e.g. 202, shown in FIG. 2A), and subsequently its blackbody radiation emission 215, shown in FIG. 2B, and its reflective properties. When the active dielectric layer 115 is laminated with a patterned FSS layer 110 configured as a series-resonant FSS such as in FIG. 3A, then electromagnetic radiation incident at the resonant frequency corresponding to the transmission dip 311, shown in FIG. 3C, is totally reflected. Incident radiation far from the resonant frequency is transmitted through the FSS layer 110 into the active dielectric 115 and is absorbed.

When the active dielectric layer 115 is laminated with a patterned FSS layer 110 configured as a parallel-resonant FSS such as in FIG. 3B, then electromagnetic radiation incident at the resonant frequency corresponding to the frequency of the transmission peak 331, shown in FIG. 3D, is transmitted through the FSS layer 110 into the active dielectric 115 and is absorbed. Incident radiation far from the resonant frequency is reflected from the FSS layer 110.

A reflecting groundplane 120 can be laminated to the backside of the dielectric layer 115 in another embodiment. The presence of the backplane does not change the qualitative function of the adaptive spectral surface. However, it can be advantageous because (1) it enhances the resonant character of the spectral surface, (2) it enables making the surface thinner, (3) an voltage can be applied to the groundplane in order to apply an electric field to the active dielectric layer 115 and modify its electrical properties, and (4) it enables the spectral surface to be fabricated in a stand-alone sheet that can be applied to existing structures.

The adaptive spectral surface modifies the spectrum of the electromagnetic radiation reflected from the surface. It also modifies the spectrum of blackbody radiation emitted by the surface by modifying the surface's emissivity with respect to frequency.

Figure 2A:
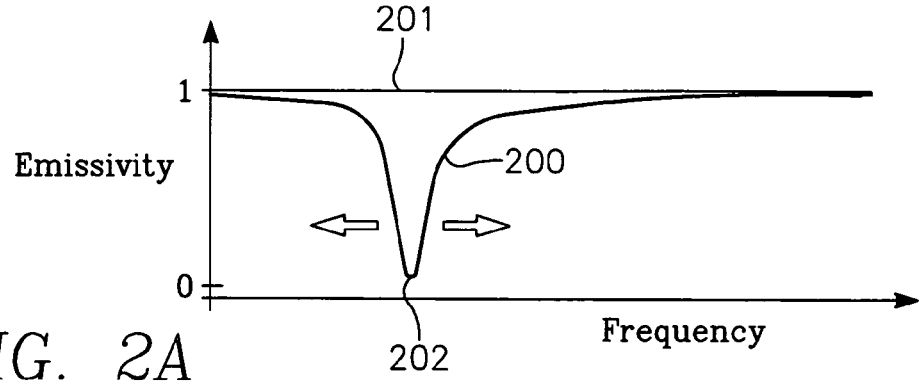
FIG. 2A is a plot showing an example of the emission spectrum, the emissivity verses frequency, of an adaptive spectral surface in accordance with an embodiment utilizing a series-resonant FSS for the frequency selective pattern.

Shown in FIG. 2A is an example of the emission spectrum, i.e. the emissivity vs. frequency 200 of an adaptive spectral surface 100 in accordance with an embodiment utilizing a series-resonant FSS for the frequency selective pattern 110. The emission spectrum 200 is characteristic of what is known as a selective radiator; a selective radiator is a body for which the emissivity varies with frequency. In contrast, a perfect emitter, i.e. a blackbody, has emissivity=1 everywhere 201, and an imperfect emitter, i.e. a "gray" body, has a constant emissivity less than 1 at all frequencies. The emission spectrum 200 has a minimum 202 and approaches 1 at frequencies far from 202. The deviation in the emission spectrum from the constant blackbody emissivity 201 is caused by the resonance of the frequency selective pattern 110. The arrows indicate that the minimum in the emissivity is variable due to changes in the active dielectric material 115 caused by the application of external stimulus such as an applied electric field, mechanical strain, or a change in temperature.

Figure 2B:
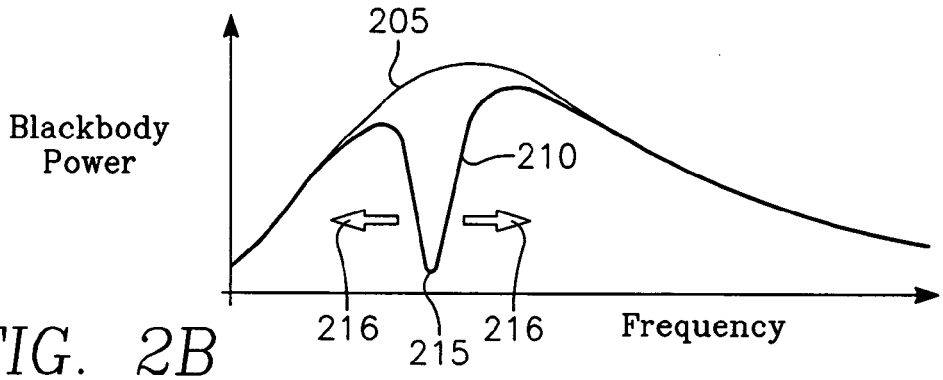
FIG. 2B is a plot illustrating the blackbody spectrum 210 corresponding to the emission spectrum of FIG. 2A.

FIG. 2B illustrates the blackbody spectrum 210 corresponding to the emission spectrum of FIG. 2A. and compares it to the emission from a perfect emitter 205. The dip in the blackbody radiation 215 corresponds to the dip in the emissivity 202.

Figure 2C:
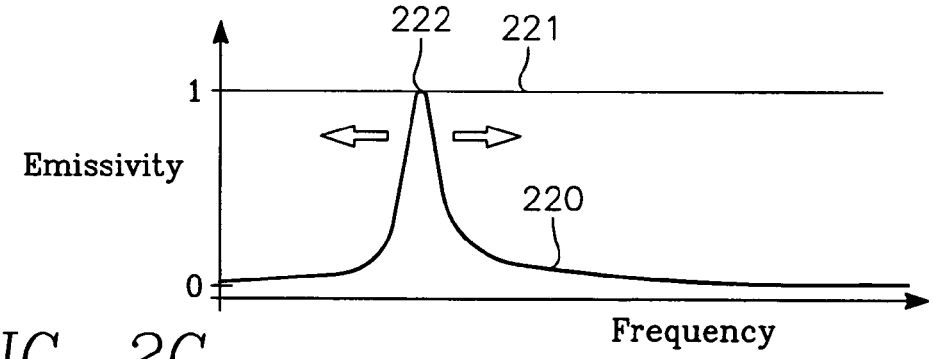
FIG. 2C is a plot showing an example of the emission spectrum, the emissivity verses frequency, of an adaptive spectral surface in accordance with an embodiment utilizing a parallel-resonant FSS for the frequency selective pattern.

Shown in FIG. 2C is an example of the emission spectrum, i.e. the emissivity verses frequency 220 of an adaptive spectral surface 100, shown in FIG. 1, in accordance with an embodiment utilizing a parallel-resonant FSS for the frequency selective pattern 110, shown in FIG. 1. The emission spectrum 220 has a maximum 222 and approaches zero at frequencies far from 222. The deviation in the emission spectrum from the constant blackbody emissivity 221 is caused by the resonance of the frequency selective pattern 110. The arrows indicate that the maximum in the emissivity is variable due to changes in the active dielectric material 115 caused by the application of external stimulus such as an applied electric field or a change in temperature.

Figure 2D:
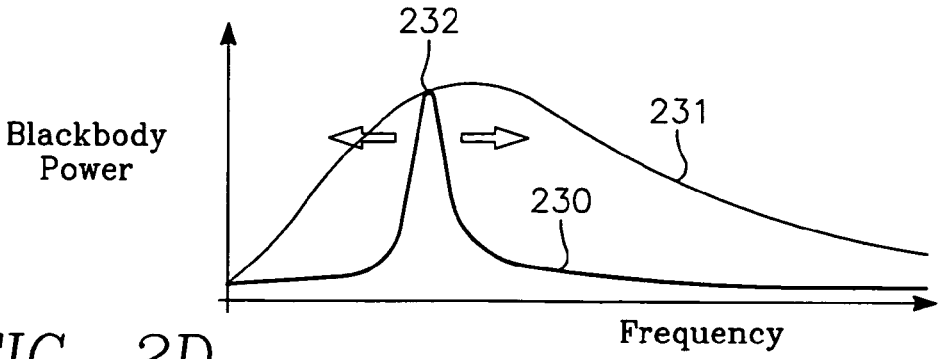
FIG. 2D is a plot illustrating the blackbody spectrum corresponding to the emission spectrum of FIG. 2C.

FIG. 2D illustrates the blackbody spectrum 230 corresponding to the emission spectrum 220 of FIG. 2C. and compares it to the emission from a perfect emitter 231. The peak in the blackbody radiation 232 corresponds to the peak in the emissivity 222.

Figure 4:
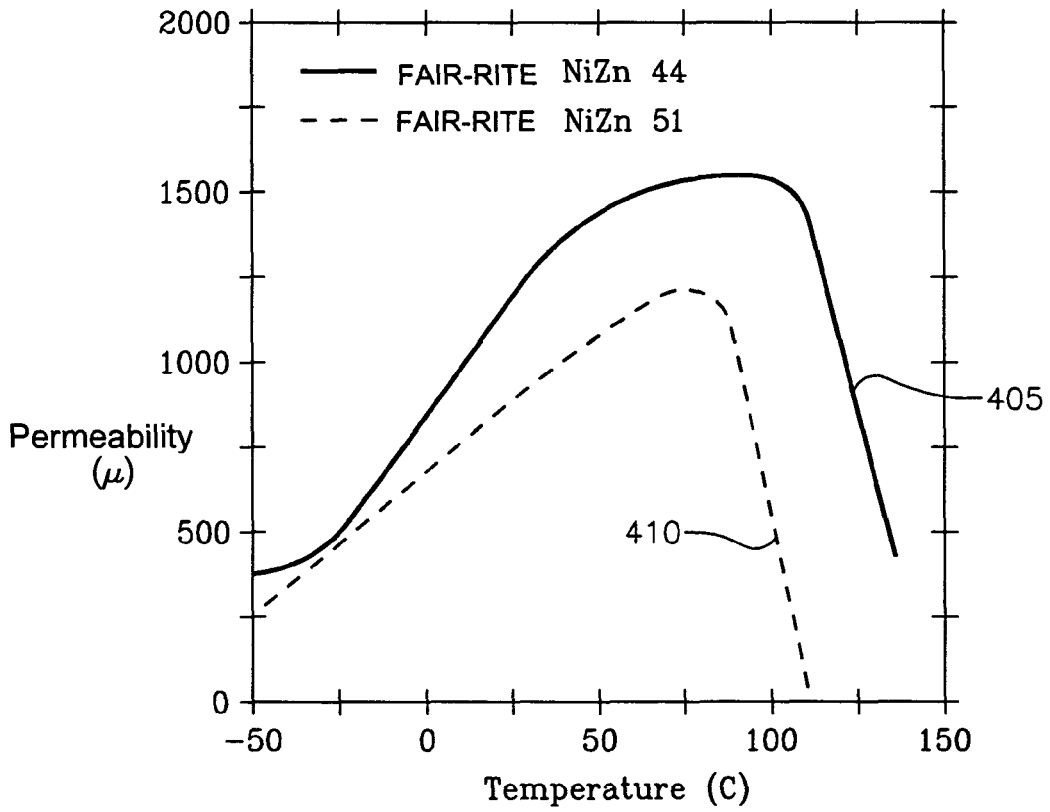
FIG. 4 is a graph of a permittivity response, in accordance with an embodiment of the present invention.

FIG. 4 corresponds to particular embodiments where the active dielectric layer 115 consists of the commercially available ferrite materials FAIR-RITE NiZn 44 and NiZn 51, available from Fair-Rite Products, Corp. Wallkill, N.Y. FIG. 4 illustrates the permeability of the active dielectric layer 115 (FIG. 1) as a function of temperature, in accordance with embodiments of the present invention. The permeability response 405 is for a dielectric material composed of FAIR-RITE NiZn 44, and the permeability response 410 is for a dielectric material composed of FAIR-RITE NiZn 51. Each permeability response 405 and 410 increases with an increase in temperature, reaches a peak at a Curie temperature of the dielectric material, and then decreases with a further increase in temperature. Thus, the permeability of the active dielectric layer 115 changes with a change in the temperature of the active dielectric layer 115. In turn, the change in permeability causes the resonant frequency of the frequency response of the adaptive spectral surface 100 to shift as indicated by arrows 216 in FIG. 2. The material shown is an example of an active dielectric that may be used. Other active dielectric materials are possible.

In one embodiment, the resonant frequency 215 (FIG. 2B) is selected to be a frequency in the visible spectrum of electromagnetic radiation. In this embodiment, changing the resonant frequency 215 causes the apparent color of the adaptive spectral surface 100 (FIG. 1) to change.

In another embodiment, the resonant frequency 215 is selected in the infrared spectrum of electromagnetic radiation. In this embodiment, changing the resonant frequency of the adaptive spectral surface 100 changes an infrared signature of the adaptive spectral surface 100. Thus, in some embodiments, the surface 100 may be a variable selective emitter, which has an emissivity that changes with frequency. As such, in some embodiments, blackbody/gray-body radiation may be controlled.

In still another embodiment, the resonant frequency 215 is selected in the microwave spectrum of electromagnetic radiation. In this embodiment, changing the resonant frequency changes a microwave signature of the adaptive spectral surface 100. For example, the reflective properties of the adaptive spectral surface 100 can be controlled.

In general, changing the resonant frequency changes the electromagnetic signature of the adaptive spectral surface 100. Although specific frequency ranges are discussed for in the examples above, embodiments are not limited to those frequencies.

In some embodiments, the permittivity of the active dielectric layer 115 (FIG. 1) may change in response to an electric field. Thus, in some embodiments, the upper layer 105 (FIG. 1) and the lower layer 120 (FIG. 1) are electrically conductive layers. The electric field may be a voltage applied between the upper layer 105 and the lower layer 120 across the active dielectric layer 115. For example, the voltage may be supplied by a power source (not shown). The voltage may be in a range of zero to two-hundred and fifty volts. Thus, the permittivity of the active dielectric layer 115 changes with a change in the voltage between the upper layer 105 and the lower layer 120. In turn, the change in permittivity causes the resonant frequency of the frequency response of the adaptive spectral surface 100 (FIG. 1) to change.

In other embodiments, thermal plates may be used to change the temperature of the active dielectric layer to shift the resonant frequency as discussed above. In yet other embodiments, a magnetic field may be generated to shift the resonant frequency of the active dielectric layer. In still other embodiments, the active dielectric layer 115 may be composed of piezoelectric materials whose electrical properties are altered with the application of pressure.

The embodiments described herein are illustrative of the present invention. As these embodiments of the present invention are described with reference to illustrations, various modifications or adaptations of the methods and/or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is to be understood that the present invention is not limited to only the embodiments illustrated.

What is claimed is:

1. An adaptive spectral surface apparatus comprising:

a) an upper layer comprising a frequency selective surface;

b) a lower layer being at least partially reflective;

c) wherein the frequency selective surface is not electrically connected to the lower layer; and d) an active dielectric material layer between the upper layer and the lower layer so as to be capable of modifying a resonance of the adaptive spectral surface without changing a composition of the active dielectric material.

2. The apparatus of claim 1, wherein the active dielectric material comprises a dielectric material capable of changing at least one of: (1) a permittivity of the active dielectric layer; (2) a permeability; or (3) a thickness of the active dielectric layer.

3. The apparatus of claim 1, wherein the active dielectric material comprises a dielectric material adapted to change at least one of: (a) a dielectric constant; or (b) a magnetic constant, in response to at least one of: (1) an applied electric field; (2) an applied magnetic field; (3) thermal stimulus; or (4) pressure.

4. The apparatus of claim 1, wherein the frequency selective surface is capable of causing an absorptive resonance in response to an electromagnetic wave incident on the frequency selective surface, and wherein the upper layer and the lower layer are configured so as to be capable of at least one of (1) providing an electric field across the active dielectric layer; (2) providing a magnetic field across the active dielectric layer; (3) changing a temperature of the active dielectric layer; or (4) applying a pressure to the active dielectric layer so as to shift the absorptive resonance in the emission.

5. The apparatus of claim 1, wherein the frequency selective surface is capable of causing a reflective resonance in response to an electromagnetic wave incident on the frequency selective surface, and wherein the upper layer and the lower layer are configured so as to be capable of at least one of: (1) providing an electric field across the active dielectric layer; (2) providing a magnetic field across the active dielectric layer; (3) changing a temperature of the active dielectric layer; or (4) applying a pressure to the active dielectric layer so as to shift the reflective resonance in the emission.

6. The apparatus of claim 1, wherein the adaptive spectral surface apparatus is capable of altering a spectrum of at least one of: (a) a reflected radiation; and (b) an emitted radiation.

7. The apparatus of claim 1, wherein the adaptive spectral surface apparatus is configured such that application of at least one of: (1) an electric field; (2) a magnetic field; (3) a thermal field; or (4) pressure across the active dielectric layer changes an electromagnetic signature of the adaptive spectral surface apparatus.

8. The apparatus of claim 1, wherein the adaptive spectral surface apparatus is configured such that application of at least one of: (1) an electric field; (2) a magnetic field; (3) a thermal field; or (4) pressure across the active dielectric layer changes a perceived color of the adaptive spectral surface apparatus.

9. The apparatus of claim 1, wherein the lower layer comprises at least one of (1) a partially reflective layer; (2) a totally reflective layer; (3) an absorptive layer; or (3) a transmissive layer.

10. The apparatus of claim 1, wherein the frequency selective surface comprises at least one of: (1) an electromagnetic crystal; (2) a photonic band gap material; (3) a metasurface; or (4) a metallic conductor.

11. The apparatus of claim 1, wherein the frequency-selective surface is substantially a reflective surface comprising a spatially-periodic pattern of transmissive portions for passing a portion of an electromagnetic wave incident on the frequency selective surface to the active dielectric material layer.

12. The apparatus of claim 11, wherein the transmissive portions comprise perpendicular linear portions.

13. The apparatus of claim 12, wherein the transmissive portions comprise a generally rectangular slot shape.

14. The apparatus of claim 11, wherein the transmissive portions comprise a cross shape.

15. The apparatus of claim 14, wherein the transmissive portions comprise a Jerusalem cross shape.

16. The apparatus of claim 1, wherein the upper layer is substantially a reflective surface comprising a spatially-periodic pattern of reflective portions for reflecting an electromagnetic wave incident on the frequency selective surface.

17. The apparatus of claim 16, wherein the reflective portions comprise perpendicular linear portions.

18. The apparatus of claim 16, wherein the reflective portions comprises a patch having generally rectangular shape.

19. The apparatus of claim 16, wherein the reflective portions comprise a Jerusalem cross shape.

20. The apparatus of claim 19, wherein the reflective portions comprise a Jerusalem cross shape.

21. An adaptive spectral surface apparatus comprising:

a) an upper layer comprising a frequency selective surface, the upper layer being electrically conductive;

b) a lower layer comprising an electrically conductive surface and being at least partially reflective, the electrically conductive surface not being connected to the frequency selective surface; and c) an active dielectric material layer between the upper layer and the lower layer, wherein the active dielectric material is responsive to a stimulus to modify a resonance of the adaptive spectral surface apparatus without changing a composition of the active dielectric material.

22. The apparatus of claim 21, wherein the active dielectric material layer and the lower layer establish a resonant frequency of a frequency response to an electromagnetic wave incident on the upper layer, and wherein the resonant frequency is a frequency peak in the frequency response.

23. The apparatus of claim 21, wherein the active dielectric material layer and the lower layer establish a resonant frequency of a frequency response to an electromagnetic wave incident on the upper layer, and wherein the resonant frequency is a frequency dip in the frequency response.

24. The apparatus of claim 21, wherein the frequency-selective surface comprises at least one of: (1) an electromagnetic crystal; (2) a photonic band gap material; (3) a metasurface; or (4) a metallic conductor.

25. The apparatus of claim 21, wherein the frequency-selective surface is substantially a transmissive surface comprising a spatially-periodic pattern of transmissive portions for passing to the active dielectric material layer a portion of an electromagnetic wave incident on the upper layer.

26. The apparatus of claim 25, wherein the spatially-periodic pattern comprises one of: (a) slots; or (b) patches of generally rectangular shape.

27. The apparatus of claim 25, wherein the spatially-periodic pattern comprises a Jerusalem cross shape.

28. The apparatus of claim 27, wherein the spatially-periodic pattern comprises a Jerusalem cross shape.

29. The apparatus of claim 21, wherein the frequency selective surface is substantially a reflective surface comprising a spatially-periodic pattern of reflective portions for reflecting an electromagnetic wave incident on the upper layer.

30. The apparatus of claim 29, wherein the spatially-periodic pattern comprises a cross shape.

31. The apparatus of claim 29, wherein the spatially-periodic pattern comprises one of patches have a generally rectangular shape.

32. The apparatus of claim 21, wherein the lower layer is further configured to absorb a portion of an electromagnetic wave incident on the lower layer.

33. The apparatus of claim 21, wherein the adaptive spectral surface apparatus is configured such that application of an electric field across the active dielectric layer changes an electromagnetic signature of the adaptive spectral surface apparatus.

34. The apparatus of claim 21, wherein the adaptive spectral surface apparatus is capable of altering a spectrum of at least one of: (a) a reflected radiation; and (b) an emitted radiation.

35. An adaptive spectral surface apparatus comprising:

a) an upper layer comprising a frequency selective surface, the upper layer being electrically conductive;

b) a lower layer comprising an electrically conductive surface and being at least partially reflective, the electrically conductive surface not being connected to the frequency selective surface;

c) an active dielectric material layer between the upper layer and the lower layer, the active dielectric layer and the lower layer establishing a spectral resonance for an electromagnetic wave incident on the frequency selective surface, and d) wherein the upper layer and the lower layer are configured so as to allow modification of a permittivity of the active dielectric layer in response to an electric field applied across the active dielectric material layer so as to shift the spectral resonance of the adaptive spectral surface apparatus.

* * * * *